US007246978B2

(12) United States Patent
Morishima et al.

(10) Patent No.: US 7,246,978 B2
(45) Date of Patent: Jul. 24, 2007

(54) NUT RETAINING APPARATUS AND NUT HOLDER

(75) Inventors: Katsunari Morishima, Osaka (JP); Youichi Zenda, Osaka (JP); Tsuyoshi Shimozato, Osaka (JP)

(73) Assignee: Kokuyo Co., Ltd. (JP)

( * ) Notice: Subject to any disclaimer, the term of this patent is extended or adjusted under 35 U.S.C. 154(b) by 23 days.

(21) Appl. No.: 10/812,360

(22) Filed: Mar. 30, 2004

(65) Prior Publication Data

US 2005/0105984 A1 May 19, 2005

(30) Foreign Application Priority Data

Nov. 13, 2003 (JP) ..... P2003-384405

(51) Int. Cl.
*F16B 37/00* (2006.01)

(52) U.S. Cl. ..... 411/104; 411/111; 411/116; 411/119; 411/120; 411/121; 411/172

(58) Field of Classification Search ..... 411/104, 411/119–121, 172, 103, 111, 112, 116
See application file for complete search history.

(56) References Cited

U.S. PATENT DOCUMENTS

| | | | | | |
|---|---|---|---|---|---|
| 192,620 | A * | 7/1877 | Eaton | 411/120 |
| 606,145 | A * | 6/1898 | Hosier | 411/120 |
| 716,018 | A * | 12/1902 | Fener | 411/120 |
| 1,272,919 | A * | 7/1918 | Crawford | 411/120 |
| 1,470,294 | A * | 10/1923 | Sell | 411/120 |
| 2,155,827 | A * | 4/1939 | Herold | 16/38 |
| 2,820,499 | A | 1/1958 | Schaaf | |
| 3,060,988 | A * | 10/1962 | Munse | 411/103 |
| 3,873,224 | A * | 3/1975 | Jakob Wollenhaupt Werkmittel | 403/381 |
| 4,089,614 | A * | 5/1978 | Harley | 403/231 |
| 4,488,844 | A * | 12/1984 | Baubles | 411/85 |
| 4,676,706 | A * | 6/1987 | Inaba | 411/175 |
| 4,761,093 | A | 8/1988 | Seymour | |
| 4,929,136 | A * | 5/1990 | Mee | 411/432 |
| 5,032,047 | A * | 7/1991 | Theakston | 411/104 |
| 5,193,643 | A * | 3/1993 | McIntyre | 180/312 |
| 5,795,117 | A * | 8/1998 | Onoda | 411/92 |
| 5,957,536 | A * | 9/1999 | Sullivan | 297/452.2 |
| 6,146,043 | A * | 11/2000 | Hasler et al. | 403/8 |
| 6,241,441 | B1 * | 6/2001 | Erb | 411/120 |
| 6,283,043 | B1 | 9/2001 | Stern | |
| 2002/0090277 | A1 * | 7/2002 | LeVey | 411/172 |

FOREIGN PATENT DOCUMENTS

| | | | |
|---|---|---|---|
| FR | 0382650 | * | 8/1990 |
| JP | 2003-105901 | | 4/2003 |

* cited by examiner

*Primary Examiner*—Katherine Mitchell
(74) *Attorney, Agent, or Firm*—Banner & Witcoff, Ltd.

(57) ABSTRACT

A body comprising a nut retaining apparatus mounted thereon for fastening a bolt to the body. The bolt is inserted into a bolt insertion hole at an end surface of the body from a direction inclined with respect to a direction tangent to the body. The nut retaining apparatus comprises a nut retainer and a nut holder, the nut retainer positioned at an insertion end of the bolt insertion hole in the body and against which a nut member having a threaded hole abuts, and the nut holder mounted on the body for supporting the nut member in the inclined direction. The nut member is retained and supported in the inclined direction at a position between the nut retainer and nut holder and continuous with the bolt insertion hole.

15 Claims, 6 Drawing Sheets

NUT RETAINING APPARATUS AND NUT HOLDER

BACKGROUND OF THE INVENTION

1. Field of the Invention

The present invention relates to a nut retaining apparatus for holding a nut member at a predetermined location, and to a nut holder.

2. Background Art

There is proposed a conventional member coupling device (see patent document 1 for example) in which when one member and the other member are to be coupled to each other using a coupling device comprising a bolt and a nut, the bolt and the nut are disposed in a direction inclined from a coupling surface to be fastened, so that of an attraction force in the inclined direction, a component of force in a direction in which the one member and the other member are to be coupled to each other is utilized as a coupling force, and a component of force in a direction perpendicular to the coupling force is utilized as a positioning force, thereby making it possible to strongly couple and position the one member and the other member with each other. This member coupling device has not only the positioning effect, but also a merit that a head of the bolt is oriented to a direction in which a tool can easily be inserted.

Patent Document 1: Japanese Patent Application Laid-Open No.2003-105901

In order to fasten the bolt in a direction inclined with respect to the coupling surface, however, it is necessary to form an internal thread in the inclined direction. To form the internal thread, a tapping working is carried out after a body is molded during the producing process, but to carry out the tapping working in the inclined direction, a process is required in which the product is supported in its inclined state. This complicates the producing process, and this increases the producing cost.

In addition, since the bolt is to be strongly fastened into the threaded hole, the body itself is required to have enough strength in order to form the threaded hole in the body. Thus, there is a demerit that kinds of materials to be used are limited.

SUMMARY OF THE INVENTION

The present invention provides a nut retaining apparatus and a nut holder capable of providing a threaded hole without limiting the selection range of materials to be used while effectively preventing the producing process from being complicated even if the threaded hole is provided, and preventing the producing cost from being increased.

To achieve the above object, the present invention provides the following means. That is, the invention provides a nut retaining apparatus in which to insert a bolt into an end surface of a body from a direction inclined with respect to a tangent direction to fasten the bolt to a threaded hole in a body, a nut member is retained in the inclined direction at a position which is continuous with a bolt insertion hole in the body, wherein the nut retaining apparatus comprises a nut retainer which is provided on an insertion end of the bolt insertion hole in the body and against which a nut member abuts to bring a threaded hole of the nut member into communication with the nut retainer, and a nut holder capable of supporting the nut member at the inclination angle, and wherein the nut holder supports the nut member and is mounted on the body, thereby retaining the nut member at a position of the nut retainer.

With this configuration, since the nut member which is a separate member from the body is fastened to the bolt, the materials of the body itself are not limited only if the nut member has sufficient strength. Since the body is not directly provided with the threaded hole, a complicated process of the tapping working in the inclined direction after molding in the producing procedure of the body can effectively be avoided, and the producing procedure can be simplified. This can reduce the producing cost. Since the nut member is supported by the nut holder and mounted on the body, the nut member can easily be held. In addition, since the nut member, the body and the nut holder can be separated from one another, they can be produced using different material if necessary, and they can easily be discriminated and recycled.

The invention also provides a nut holder in which to insert a bolt into an end surface of a body from a direction inclined with respect to a tangent direction to fasten the bolt to the body, a nut member is retained in the inclined direction at a predetermined position in the body, wherein a nut member is supported in the inclined direction, the nut holder is mounted from the inclined direction from the inserting direction of the bolt in a state in which the nut member is supported, thereby holding the nut member in the predetermined position.

With this configuration, the nut member is first mounted on the nut holder which is a separate member from the body and then, the nut member can reliably and easily be inserted to the position of the nut retainer and supported. Thus, the tapping working in the inclined direction in the producing procedure of the body can effectively be avoided, and the producing procedure can be simplified. When the nut member is mounted, it is possible to eliminate a troublesome operation to insert a finger to a position of the nut retainer to insert the nut member. Thus, the operation time and labor required for mounting the nut member can largely be reduced.

In order to reliably mount the nut member and preferably support the same, it is preferable that the nut holder of the present invention comprises an engaging portion capable of engaging with the body, a side surface support portion supporting a side surface of the nut member, and an end surface support portion for supporting an end surface of the nut member. In the case where the nut member is of a hexagonal columnar shape such as a commercially available nut member, the side surface support portion which forms a V-shaped groove enables that the corner of the hexagonal columnar is located at the lowermost position to support the two surfaces, and that the nut member is supported more stably. That is, a commercially available inexpensive nut member can preferably be used. If the end surface support portion has a bolt insertion hole through which the bolt can be inserted, the nut holder does not interfere with the bolt and the bolt can reliably be fastened even in the case where the bolt passes through the nut member. If the nut holder can be mounted on the body from below, even in the case where the nut is to be held at a position where the nut normally falls, the nut holder can be allowed to function as a falling-preventing member of the nut and the nut can be held. To produce the nut holder inexpensively to reduce the cost, it is preferable that the nut holder is made of resin.

According to the nut retaining apparatus, the nut retainer comprises a side surface retainer which comes into contact with the side surface of the nut member, and an end surface retainer which comes into contact with an end surface of the nut member. With this configuration, when the bolt is to be fastened, the side surface retainer reliably prevents the nut from being rotated in the rotation direction of the bolt, and the end surface retainer reliably can exhibit an attraction force of the bolt. To reduce the weight of the nut retaining apparatus, it is preferable that the body is formed of aluminum into by die casting.

The nut retaining apparatus of the present invention constitutes a member coupling device which couples the pipe member to the end surface of the body. More specifically, the end surface of the body includes a positioning section, a bolt is fastened to the nut member, thereby bringing the pipe member into abutment against the positioning section, and the member coupling device couples the pipe member while positioning the pipe member. With this configuration, stronger effect can be obtained. More concretely, in a member coupling device for coupling a lateral cross member to a supporting structure which constitutes furniture having a top, the effect can sufficiently be exhibited.

According to the nut retaining apparatus of the present invention, as described above, since the nut member which is the separate member from the body is fastened to the bolt, the materials for the body itself are not limited only if the nut member has sufficient strength. Since the body is not directly formed with the threaded hole, the tapping working can effectively be avoided, and the producing process can be simplified. This reduces the producing cost. Since the nut member is supported by the nut holder and mounted on the body, the nut member can easily be held. In addition, since the nut member, the body and the nut holder can be separated from one another, they can be produced using different material if necessary, and they can easily be discriminated and recycled.

According to the nut holder of the present invention, the nut member is first mounted on the nut holder which is a separate member from the body and then, the nut member can reliably and easily be inserted to the position of the nut retainer and supported. Thus, the tapping working in the inclined direction in the producing procedure of the body can effectively be avoided, and the producing procedure can be simplified. When the nut member is mounted, it is possible to eliminate a troublesome operation to insert a finger to a position of the nut retainer to insert the nut member. Thus, the operation time and labor required for mounting the nut member can largely be reduced.

BEST MODE FOR CARRYING OUT THE INVENTION

An embodiment of the present invention will be explained with reference to the drawings below.

Figure 1:
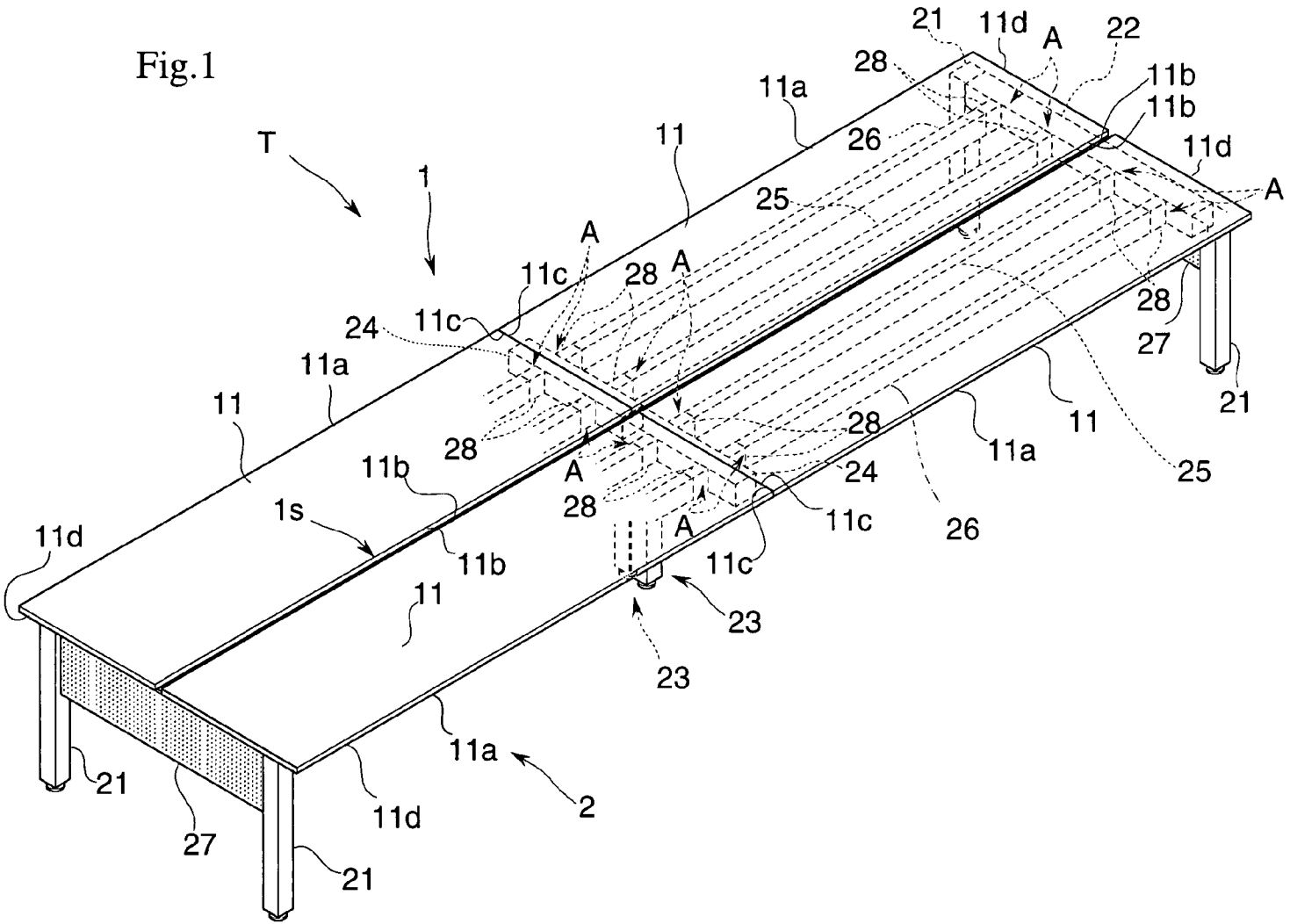
FIG. 1 is a perspective view showing an embodiment of the present invention.
Figure 2:
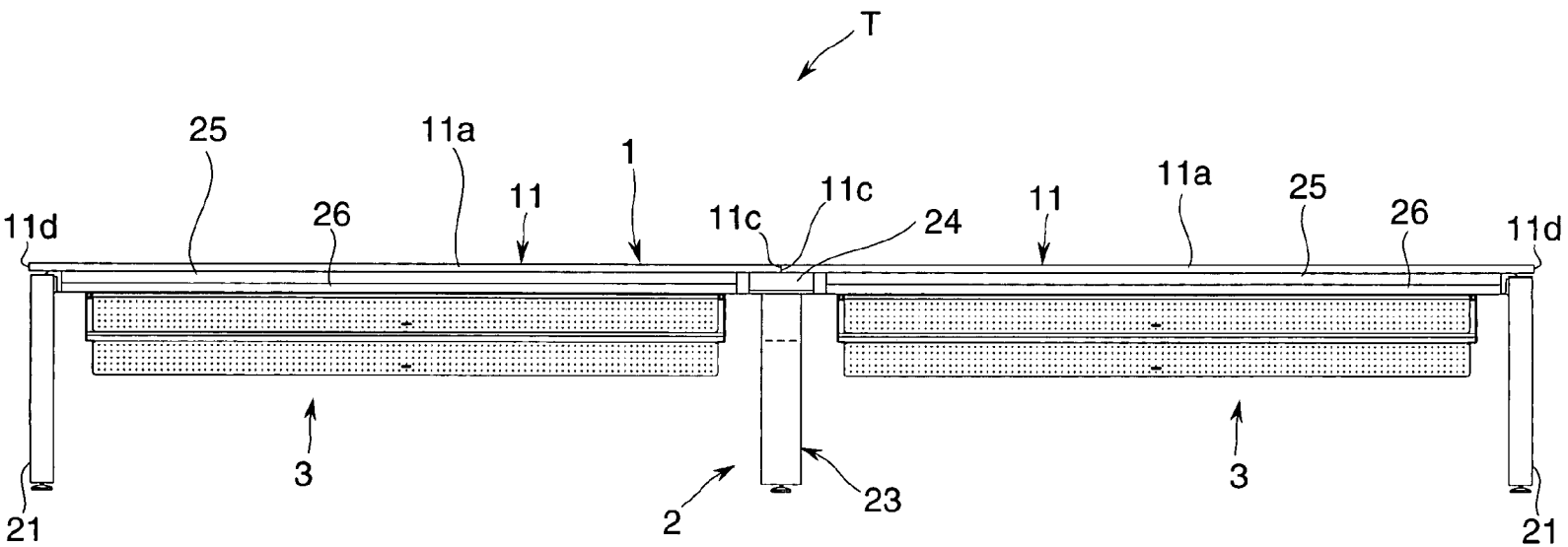
FIG. 2 is a front view.
Figure 3:
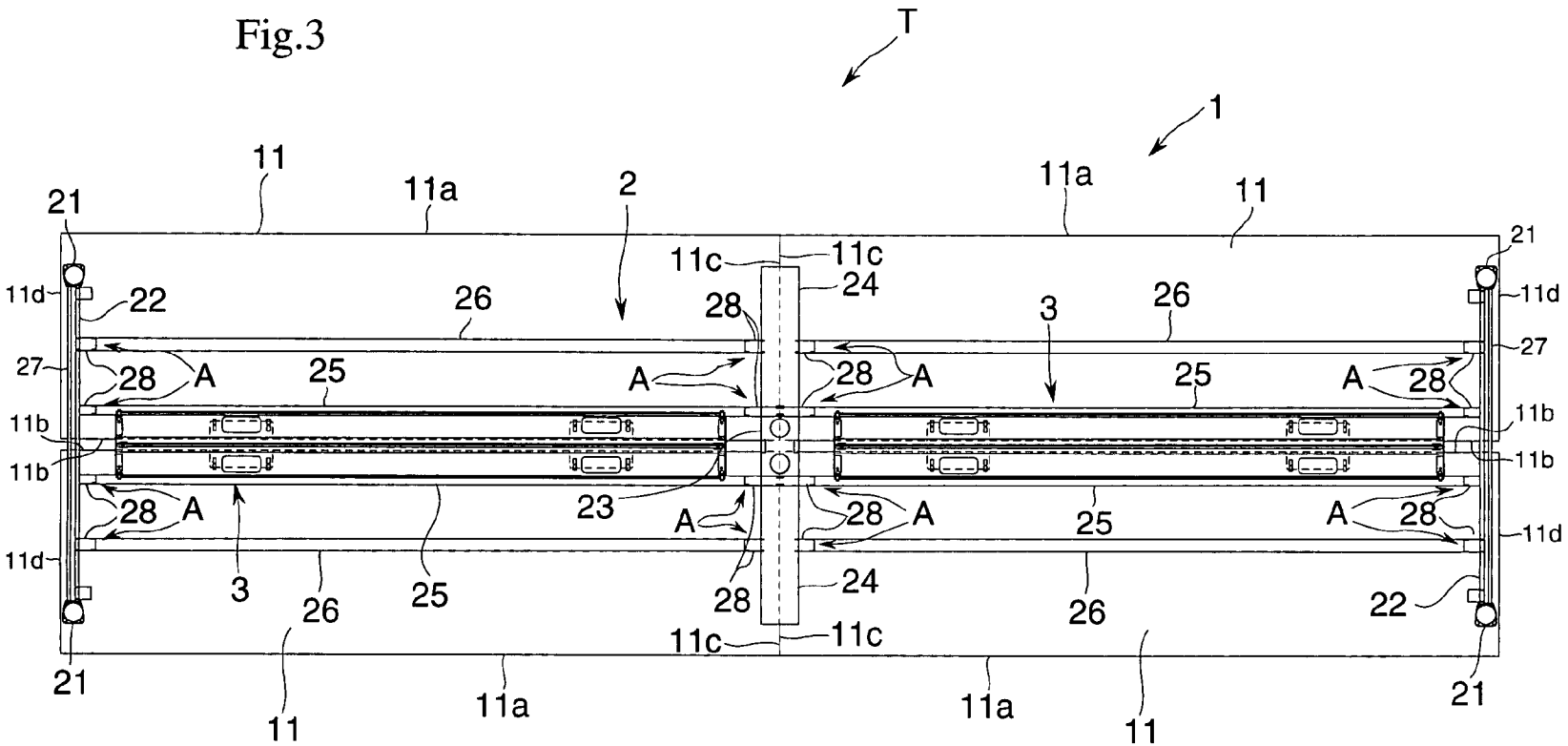
FIG. 3 is a bottom view.

The furniture with a top shown in FIGS. 1 to 3 is a large table T used in a so-called free-address office where seats are not determinate. The table T comprises a top 1, a supporting structure 2 for supporting the top 1, and wire ducts 3 disposed in a space below the top 1.

In this embodiment, the top 1 comprises a plurality of top elements 11. More specifically, four top elements 11 are used. The top element 11 is rectangular in shape as viewed from above. Of the four top elements 11, two top elements 11, 11 are combined as one set. Non-using ends 11*b* thereof are opposed to each other, and the set of top elements 11, 11 is disposed such that inner ends 11*c* thereof are adjacent to each other. With this configuration, the non-using ends 11*b* of the top elements 11 are collected at the central portion of the depth direction of the entire top 1, and the using ends 11*a* of the top elements 11 are positioned at opposite ends in the depth direction. A gap 1*s* of a predetermined distance is formed between the using ends 11*b*, 11*b* of the longitudinal pair of top elements 11. This gap l*s* is in communication with the wiring space of the wire ducts 3.

The supporting structure 2 comprises total four end legs 21 disposed in the vicinity of the outer side end 11*d* of each the top element 11 on the side of the using end 11*a*, side frames 22 and 22 which connect the pair of end legs 21 and 21 arranged in the depth direction of the top 1 to each other, an intermediate leg 23 disposed on the side of the inner end 11*c* of each top element 11 on the side of the non-using end 11*b*, the pair of front and rear arms 24 and 24 which are supported by the intermediate leg 23 and which support the top elements 11 on the side of the inner end 11*c*, and total eight lateral frames (four first lateral frames 25, 25, 25, 25 and second lateral frames 26, 26, 26, 26) which are lateral cross members (so-called pipe members) which connect the side frames 22 and 22 and the arms 24 and 24 to each other along a widthwise direction of the top 1. The first lateral frames 25, 25, 25, 25 support the non-using ends 11*b* of the top elements 11. The second lateral frames 26, 26, 26, 26 support the central portions of the top elements 11 in the depth direction. The left and right side frames 22 and 22 are provided with side modesty panels 27, 27 which block a space below the top 1 from a sight from side.

Figure 4:
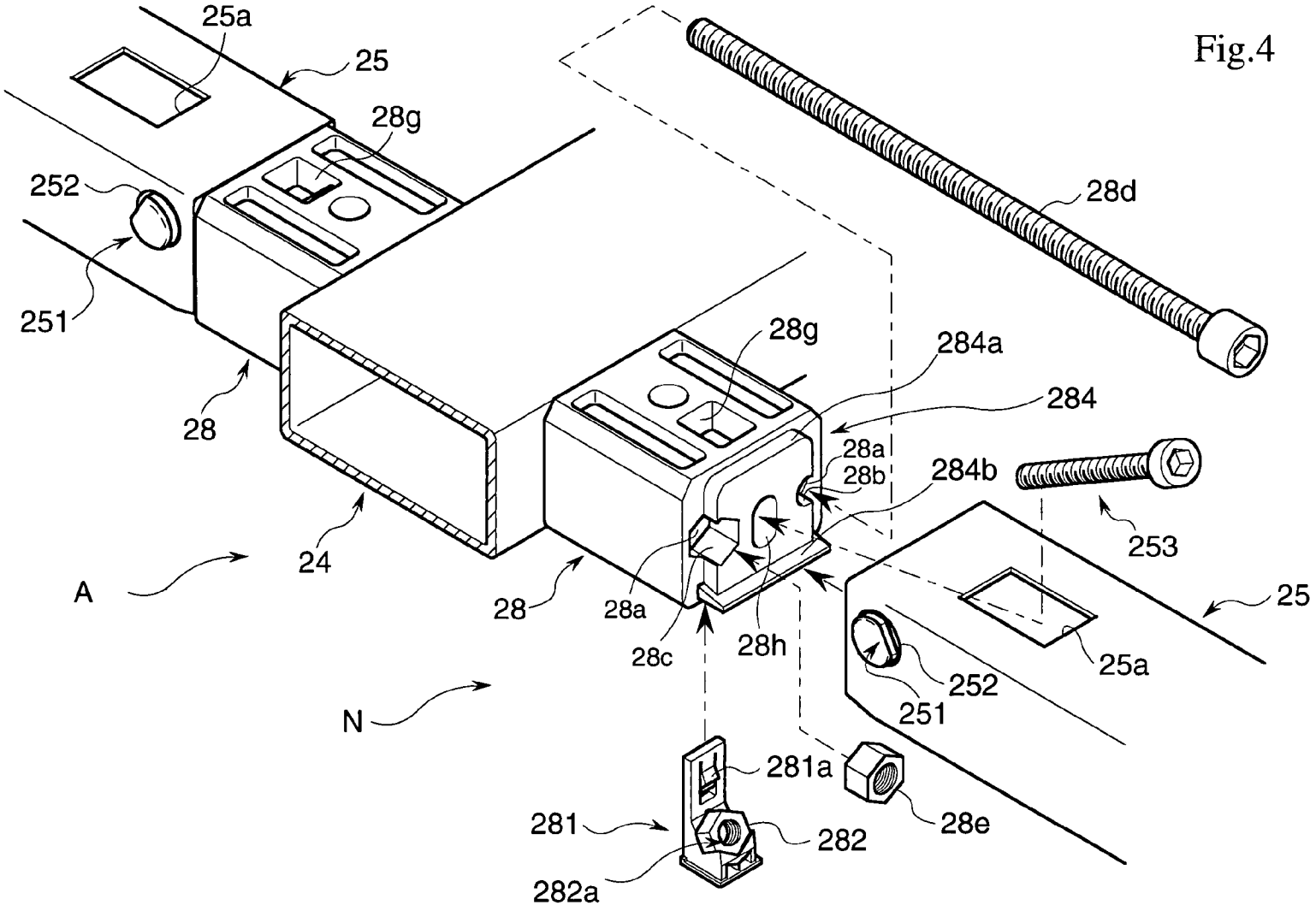
FIG. 4 is a perspective view of a connection portion between an arm and a first lateral frame of the embodiment.

In the supporting structure 2 of this embodiment as described above, the arms 24 and the side frames 22 are connected to each other through the four first lateral frames 25 and the second lateral frames 26. The first lateral frame 25 and the second lateral frame 26 are connected to the arm 24 and the side frame 22 at the side ends utilizing a member coupling device A using a connection body 28. The member coupling device A will be explained based on the connection portion between the first lateral frame 25 and the arm 24 with reference to FIGS. 4 to 6. The connection bodies 28 and 28 projecting toward opposite sides of the arm 24 are mounted on the arm 24. The first lateral frames 25 and 25 are mounted on the arm 24 through the connection bodies 28 and 28. The connection body 28 is integrally formed of aluminum into a block by die casting for reducing the weight while keeping the strength. The connection body 28 is formed with a pair of left and right bolt through holes 28*a* and 28*a* which passes through the opposite side surfaces. One of the bolt through holes 28*a* is formed with a bolt head accommodation hole 28*b* at its outer end, and the other bolt through hole 28*a* is formed with a nut accommodation hole 28*c* at its outer end. In a state in which the same connection bodies 28 and 28 are disposed on the left and right sides of the arm 24 at one location of the arm 24 in its longitudinal direction, a shaft of a bolt 28*d* inserted into the bolt through hole 28*a* from the bolt head accommodation hole 28*b* of the connection body 28 is inserted into the bolt through hole 28*a* of the other connection body 28 across the arm 24, the shaft is fastened to the nut 28*e* provided in the nut accommodation hole 28*c* connected to the bolt through hole 28*a*, thereby fixing the pair of connection bodies 28 and 28 to the arm 24. The positioning of the connection body 28 with respect to the arm 24 is carried out by bumps and dips engagement between the projection 28*f* projecting from the inner end of the connection body 28 toward the arm 24 and a projection accommodating hole 24*a* formed in the arm 24 in correspondence with the projection 28*f*.

A fixing pin 251 to be mounted on the connection body 28 is mounted on an inner end of the first lateral frame 25 in the depth direction utilizing a fixing tool such as a C-ring 252. The fixing pin 251 is formed with a bolt support hole 251*a* which is opened obliquely so as to be arranged on a straight line with respect to a threaded hole 282*a* of a nut 282 mounted on the connection body 28. A shaft of the bolt 253 which is obliquely inserted into the bolt support hole 251*a* from above is fastened to the nut 282 through a bolt insertion hole 28*h*. To insert and pull out the bolt 253 into and from the first lateral frame 25, an opening window 25*a* is formed on an upper surface of the first lateral frame 25 in the vicinity of the inner end thereof. The connection body 28 is positioned with respect to the first lateral frame 25 by engaging a positioning section 284 projecting toward the first lateral frame 25 with an outer end surface of the connection body 28. More specifically, the connection body 28 is positioned with respect to the first lateral frame 25 by bringing the first positioning projection 284*a* and the second positioning projection 284*b* into abutment against an upper end and a lower end of the inner end of the first lateral frame 25, respectively.

In this embodiment, in the member coupling device A, a nut retaining apparatus N is employed for connecting the connection body 28 and the first lateral frame 25 to each other. The connection body 28 is provided at its central portion in its widthwise direction with a vertical hole 28*g* into which the nut 282 for fixing the first lateral frame 25 is accommodated. A step 28*ga* is formed in the vicinity of an upper end of the vertical hole 28*g*. A wall surface of the step 28*ga* is an upwardly oriented surface. A nut holder 281 is inserted into the vertical hole 28*g* from below to hold the same so that the nut 282 can easily be mounted and the nut 282 does not fall out from the vertical hole 28*g*.

Figure 5A:
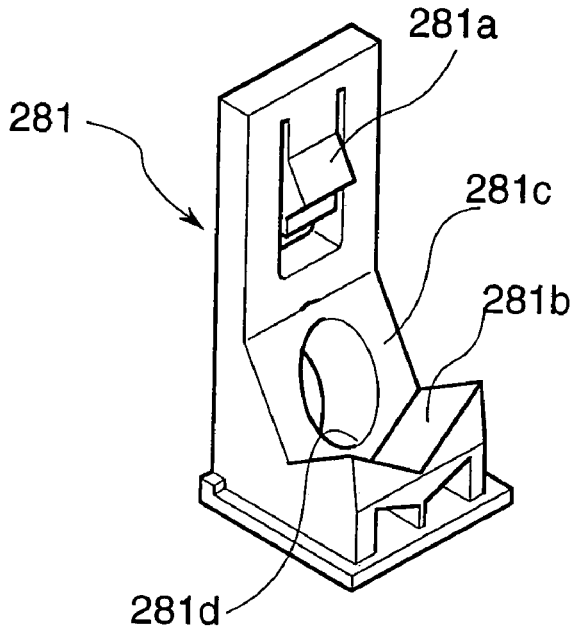
FIGS. 5(A) and 5(B) are perspective view showing a nut holder of the embodiment.
Figure 5B:
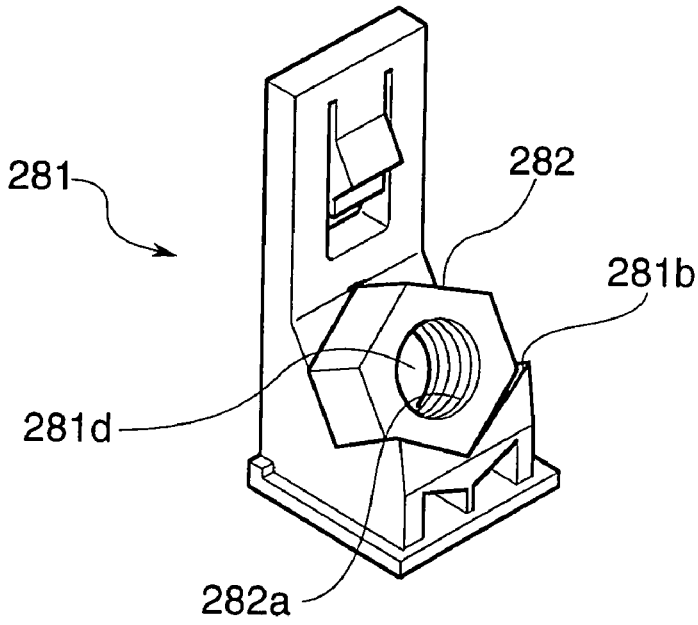

As shown in FIGS. 5(A) and 5(B), the nut holder 281 holds the nut 282. The nut holder 281 is made of synthetic resin which can generally be produced inexpensively. The nut holder 281 is formed at its upper end with an engaging portion 281*a* which is resiliently deformable so that the nut holder 281 can reliably be mounted on the connection body 28. The nut holder 281 includes a side surface support portion 281*b* which supports a side surface of the nut 282 and an end surface support portion 281*c* which supports an end surface of the nut 282 so that the nut holder 281 can preferably support the nut 282 in its attitude in which the nut 282 is obliquely, i.e., upwardly and outwardly oriented. The end surface support portion 281*c* is provided with a bolt insertion hole 281*d* (FIG. 5(A)) at its central portion. The nut 282 is of a hexagonal columnar shape and is commercially available. The side surface support portion 281*b* is formed with a V-shaped groove corresponding to an outer shape of the nut 282 so that the nut holder 281 can abut against and support the nut 282 suitably. Therefore, if a corner of the nut 282 is located at the lowermost location to support two side surfaces of the nut 282, the nut 282 can be supported stably and deeply in the vertical direction (FIG. 5(B)).

Figure 6:
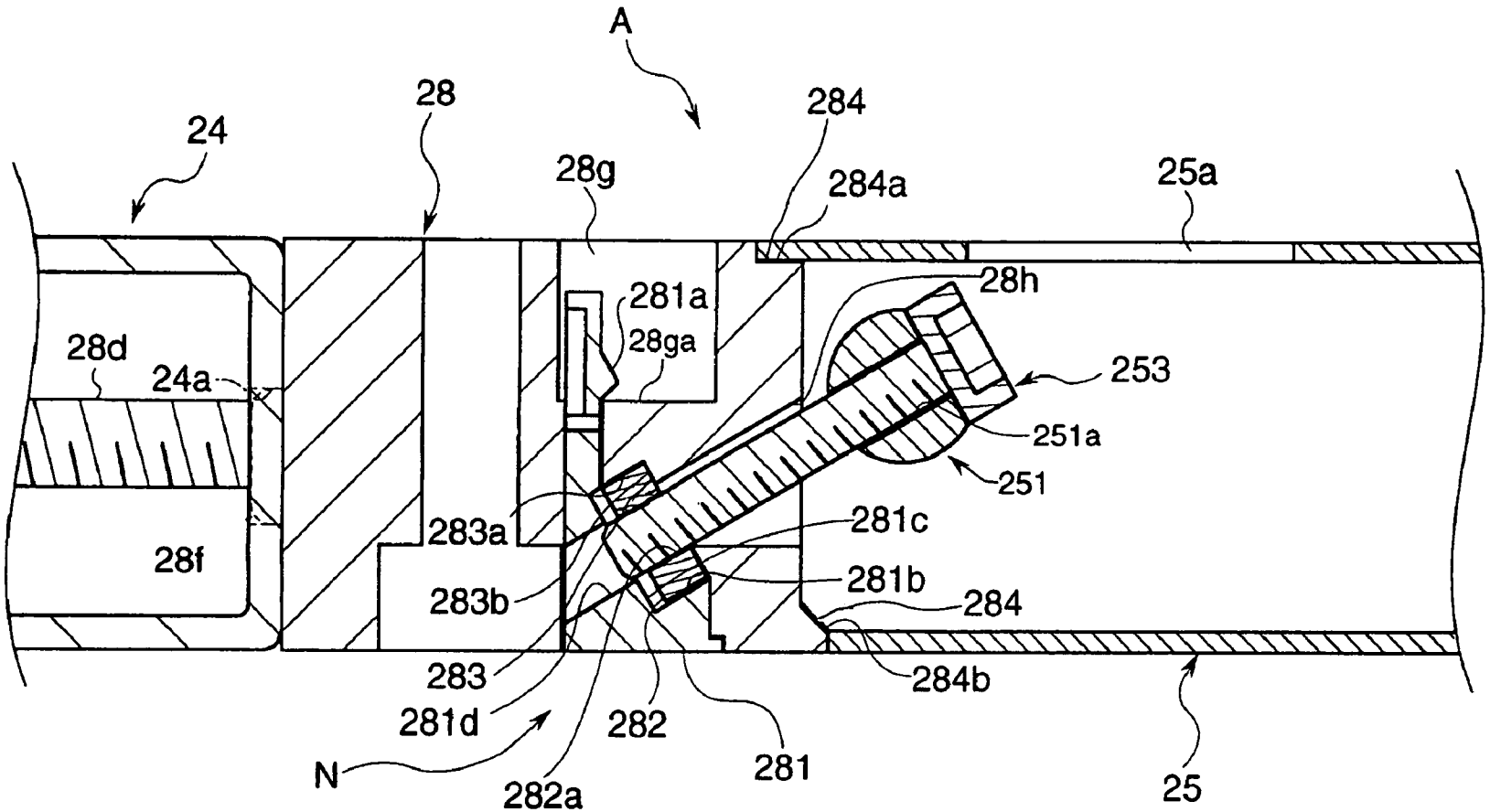
FIG. 6 is a sectional view showing the connection portion between the arm and the first lateral frame of the embodiment.

As shown in FIG. 6, in order to hold the nut 282 on the connection body 28 using the nut holder 281, the nut holder 281 which supports the nut 282 is inserted into the vertical hole 28*g* from a lower portion of the connection body 28, the engaging portion 281*a* formed in the upper end is engaged with the step 28*ga*, and the nut 282 is mounted on the connection body 28. The connection body 28 is formed with a bolt insertion hole 28*h* from which the nut 282 is exposed obliquely, i.e., upwardly and outwardly. In this state, the threaded hole 282*a* of the nut 282 is in communication with the bolt insertion hole 28*h*.

When the bolt 253 is fastened to the nut retaining apparatus N to threadedly engaging the nut 282 and the bolt 253 with each other, the nut 282 moves obliquely upward and abuts against the nut retainer 283. More specifically, the nut 282 abuts against a side surface retainer 283*a* to prohibit the nut 282 from rotating, the nut 282 abuts against an end surface retainer 283*b* to prohibit the nut 282 from moving obliquely upward, and the bolt 253 and the nut 282 are reliably threadedly engaged with each other. At that time, the nut 282 moved obliquely upward from a position where the nut 282 was supported by the nut holder 281, and the nut 282 and the nut holder 281 do not come into contact with each other. Thus, a fastening force when the bolt 253 is fastened is applied only to the connection body 28, and the fastening force is not applied to the resin nut holder 281. Even if a long bolt 253 is used, a tip end of the bolt 253 passes through the bolt insertion hole 281*d* formed in the nut holder 281 such that the tip end which passes through the nut 282 does not come into contact with the nut holder 281 and thus, the nut holder 281 does not interfere with the bolt 253.

As described above, by obliquely fastening the bolt 253 and the nut 282 fixed to the connection body 28, the upper end of the inner end of the first lateral frame 25 abuts against the first positioning projection 284*a* which constitutes the positioning section 284, and the lower end of the inner end of the first lateral frame 25 abuts against the second positioning projection 284*b*, and the first lateral frame 25 is each fixed to the arm 24 while exhibiting the vertical positioning effect. Therefore, high mounting strength can be obtained, and the bending of the first lateral frame 25 and the positional deviation thereof in the vertical direction can be prevented.

Since the lower end of the inner end of the first lateral frame 25 is cut off obliquely, even if the first lateral frame 25 is mounted in such a manner as to cover the outer end of the connection body 28 from above, the lower end of the inner end of the first lateral frame 25 does not abut against the first positioning projection 284*a*, the cut end surface abuts against the second positioning projection 284*b*, it is disposed at a predetermined location and thus, the table T can smoothly be assembled.

Even if the height of the first lateral frame 25 is reduced to a relatively small value, sufficient mounting strength can be obtained. As described above, the member coupling device A of this embodiment is common for the arm 24 and the side frame 22, and for the first lateral frame 25 and the second lateral frame 26. Therefore, the strength of the entire supporting structure 2 is enhanced, and the arm 24, the side frame 22, the first lateral frame 25 and the second lateral frame 26 are reduced in thickness. The connection body 28 is appropriately mounted on the side frame 22 using a bolt or the like, and the first lateral frame 25 and the second lateral frame 26 are connected to each other through the member coupling device A.

According to the nut retaining apparatus N of this embodiment as described above, the nut 282 which is a nut member separated from the connection body 28 as a body is fastened to the bolt 253. Thus, the material of the connection body 28 is not limited only if the nut 282 has sufficient strength. The connection body 28 is not directly formed with a hole for the internal thread. Therefore, in the producing process of the connection body 28, a complicated procedure for tapping the molded connection body 28 in the inclined direction can effectively be avoided, and the producing process can be simplified. This can reduce the producing cost. Further, since the nut 282 is supported by the nut holder 281 and is mounted on the connection body 28, the nut 282 can easily be held. In addition, since the nut 282, the connection body 28 and the nut holder 281 can be separated from one another, they can be produced using different material if necessary, and they can easily be discriminated and recycled.

According to the nut holder 281 of this embodiment, in order to insert the bolt 253 into the end surface of the connection body 28 as the body from a direction inclined from a tangent direction to fasten the bolt 253 to the connection body 28, the nut is held in the inclined direction at the position of the nut retainer 283 which is in the predetermined position in the connection body 28, and the nut 282 is supported in the inclined direction. In a state in which the nut 282 is supported, the nut 282 is mounted from a direction inclined from the inserting direction of the bolt 253. With this, the nut 282 is held at the position of the nut retainer 283.

With this configuration, the tapping working in the inclined direction in the producing procedure of the body can effectively be avoided, and the producing procedure can be simplified. When the nut 282 is mounted, it is possible to eliminate a troublesome operation to insert a finger to a position of the nut retainer 283 located in the connection body 28 to insert the nut 282. If the nut holder 281 is inserted after the nut 282 is first mounted on the nut holder 281 which is separated from the connection body 28, the nut 282 can reliably and easily be inserted to the position of the nut retainer 283 and supported. Thus, the operation time and labor required for mounting the nut 282 can largely be reduced.

Although the embodiment of the present invention has been explained above, concrete structures of each part is not limited to the embodiment only, and various modifications can be made within a range not departing from the subject matter of the present invention.

For example, the nut holder is inserted from the lower side of the connection body in the embodiment, but the nut holder can be inserted from another direction of course. In that case also, if the nut holder is made of resin as in the embodiment, cost can be reduced. Further, since the nut holder can easily be molded into various shapes, it can be produced preferably.

Other concrete structures are not limited to those in the above embodiment, and various modifications can be made within a range not departing from the subject matter of the present invention.

What is claimed is:

1. An apparatus comprising a body, a nut holder, and a nut member, wherein the body comprises an end surface, a bolt insertion hole, and a nut retainer, a bolt being insertable into the bolt insertion hole from the end surface of the body in a predetermined inclined direction and past the nut retainer before the bolt is fastened to the nut member, the nut retainer positioned at an insertion end of the bolt insertion hole in the body and against which a nut member having a threaded hole abuts, and the nut holder mounted on the body for supporting the nut member securely in the predetermined inclined direction before the bolt is fastened, wherein the nut holder comprises an engaging portion engaging with the body, and a side surface support portion supporting a side surface of the nut member, and an end surface support portion supporting an end surface of the nut member, wherein the side surface support portion forms a V-shaped groove, wherein the nut member is retained and supported in the predetermined inclined direction at a position between the nut retainer and the nut holder and continuous with the bolt insertion hole; and wherein, when the bolt is fastened to the nut member, a fastening force is applied directly to the nut retainer by the nut member and not to the nut holder.

2. The apparatus according to claim 1, wherein the end surface support portion includes a bolt insertion hole in communication with the threaded hole of the nut member.

3. The apparatus according to claim 1, wherein the nut retainer includes a side surface retainer for contact with a side surface of the nut member, and an end surface retainer for contact with an end surface of the nut member.

4. An apparatus comprising a body, a nut holder, and a nut member, wherein the body comprises an end surface, a bolt insertion hole, and a nut retainer, a bolt being insertable into the bolt insertion hole from the end surface of the body in a predetermined inclined direction and past the nut retainer before the bolt is fastened to the nut member, the nut retainer positioned at an insertion end of the bolt insertion hole in the body and against which a nut member having a threaded hole abuts, and the nut holder mounted on the body for supporting the nut member securely in the predetermined inclined direction before the bolt is fastened, wherein the nut holder is mounted to the body from below the body, wherein the nut member is retained and supported in the predetermined inclined direction at a position between the nut retainer and the nut holder and continuous with the bolt insertion hole; and wherein, when the bolt is fastened to the nut member, a fastening force is applied directly to the nut retainer by the nut member and not to the nut holder.

5. The apparatus according to claim 4, wherein the nut holder is made of resin.

6. The apparatus according to claim 4, wherein the body is made of aluminum by die casting.

7. The apparatus according to claim 4, wherein the end surface of the body includes a positioning section for coupling a lateral frame member to the end surface of the body, wherein when the bolt is fastened to the nut member, the lateral frame member is brought into abutment against the positioning section.

8. The apparatus according to claim 4, wherein the nut retainer includes a side surface retainer for contact with a side surface of the nut member, and an end surface retainer for contact with an end surface of the nut member.

9. An apparatus comprising a body, a nut holder, and a nut member, wherein the body comprises an end surface, a bolt insertion hole, and a nut retainer, a bolt being insertable into the bolt insertion hole from the end surface of the body in a predetermined inclined direction and past the nut retainer before the bolt is fastened to the nut member, the nut retainer positioned at an insertion end of the bolt insertion hole in the body and against which a nut member having a threaded hole abuts, and the nut holder mounted on the body for supporting the nut member securely in the predetermined inclined direction before the bolt is fastened, wherein the nut holder comprises an engaging portion engaging with the body, and a side surface support portion supporting a side surface of the nut member, and an end surface support portion supporting an end surface of the nut member, wherein the nut holder is mounted to the body from below the body, wherein the nut member is retained and supported in the predetermined inclined direction at a position between the nut retainer and the nut holder and continuous with the bolt insertion hole; and wherein, when the bolt is fastened to the nut member, a fastening force is applied directly to the nut retainer by the nut member and not to the nut holder.

10. The apparatus according to claim 9, wherein the nut retainer includes a side surface retainer for contact with a side surface of the nut member, and an end surface retainer for contact with an end surface of the nut member.

11. An apparatus comprising a body having a bolt insertion hole and a nut holder for fastening a bolt to the body, the bolt being insertable into an end surface of the body and through the bolt insertion hole in a predetermined inclined direction, wherein the nut holder is mounted on the body in the predetermined inclined direction from the inserting direction of the bolt in a state wherein a nut member is supported in the predetermined inclined direction, thereby holding the nut member in a predetermined position; and wherein, when the bolt is fastened to the nut member, a fastening force is applied directly to the body and not to the nut holder;

the apparatus further comprising an engaging portion capable of engaging with the body, a side surface support portion supporting a side surface of the nut member, and an end surface support portion for supporting an end surface of the nut member, wherein the side surface support portion forms a V-shaped groove.

12. The apparatus according to claim 11, wherein the end surface support portion includes a bolt insertion hole through which the bolt can be inserted.

13. An apparatus comprising a body having a bolt insertion hole and a nut holder for fastening a bolt to the body, the bolt being insertable into an end surface of the body and through the bolt insertion hole in a predetermined inclined direction, wherein the nut holder is mounted on the body in the predetermined inclined direction from the inserting direction of the bolt in a state wherein a nut member is supported in the predetermined inclined direction, thereby holding the nut member in a predetermined position; and wherein, when the bolt is fastened to the nut member, a fastening force is applied directly to the body and not to the nut holder; wherein the nut holder is mounted on the body from below the body.

14. The apparatus according to claim 13, further comprising an engaging portion capable of engaging with the body, a side surface support portion supporting a side surface of the nut member, and an end surface support portion for supporting an end surface of the nut member.

15. The apparatus according to claim 13, wherein the nut holder is made of resin.

* * * * *